US012173894B2

(12) United States Patent
Wiggen et al.

(10) Patent No.: US 12,173,894 B2
(45) Date of Patent: Dec. 24, 2024

(54) REGENERATIVE BURNER FOR STRONGLY REDUCED NOX EMISSIONS

(71) Applicants: Gautschi Engineering GmbH, Berg TG (CH); EBNER Industrieofenbau GmbH, Leonding (AT); HPI High Performance Industrietechnik GmbH, Braunau-Ranshofen (AT)

(72) Inventors: Werner Wiggen, Constance (DE); Markus Mayrhofer, Scharnstein (AT); Michael Koller, Leonding (AT); Andreas Kraly, Neumarkt am Wallersee (AT)

(73) Assignees: Gautschi Engineering GmbH, Berg (CH); Ebner Industrieofenbau Gmbh, Leonding (AT); HPI High Performance Industritechnik GmbH

( * ) Notice: Subject to any disclaimer, the term of this patent is extended or adjusted under 35 U.S.C. 154(b) by 0 days.

(21) Appl. No.: 17/001,263

(22) Filed: Aug. 24, 2020

(65) Prior Publication Data

US 2021/0063013 A1 Mar. 4, 2021

(30) Foreign Application Priority Data

Aug. 27, 2019 (DE) ..... 102019122940.5

(51) Int. Cl.
*F23C 6/04* (2006.01)
*F23C 7/00* (2006.01)

(52) U.S. Cl.
CPC ..... *F23C 6/045* (2013.01); *F23C 7/00* (2013.01); *F23C 2201/20* (2013.01); *F23D 2201/20* (2013.01); *F23D 2900/31019* (2021.05)

(58) Field of Classification Search
None
See application file for complete search history.

(56) References Cited

U.S. PATENT DOCUMENTS 2,187,674 A * 1/1940 Anderson ..... F23D 14/04 239/553.5
3,101,773 A * 8/1963 Blaha ..... F23D 14/20 431/166

(Continued)

FOREIGN PATENT DOCUMENTS

CN 103206711 7/2013
DE 4142401 A1 6/1993

(Continued)

OTHER PUBLICATIONS

Office Action issued in parallel Chinese Patent Application No. 202010877441.5, Dec. 20, 2022, 15 pages.

*Primary Examiner* — Jason Lau
(74) *Attorney, Agent, or Firm* — HSML P.C.

(57) ABSTRACT

The invention relates to a burner with a refractory burner body 1, 2, 3 for burning liquid or aerosol fuels, in particular, gaseous fuels. With the aim of reducing $NO_x$ emissions, the burner body comprises a gas nozzle 7, 9, 10, 11 and a plurality of air nozzles 4, 6, which are at least partially formed as integral mouldings in the burner body and flow out on a front side 16 of the burner body. Here, the air nozzles are symmetrically arranged around the gas nozzle and diverge at an angle α to the gas nozzle. Likewise, the invention relates to a method for burning liquid or aerosol fuels, in particular, gaseous fuels with reduced $NO_x$ emissions.

12 Claims, 1 Drawing Sheet

(56) References Cited

U.S. PATENT DOCUMENTS

Figure 1:
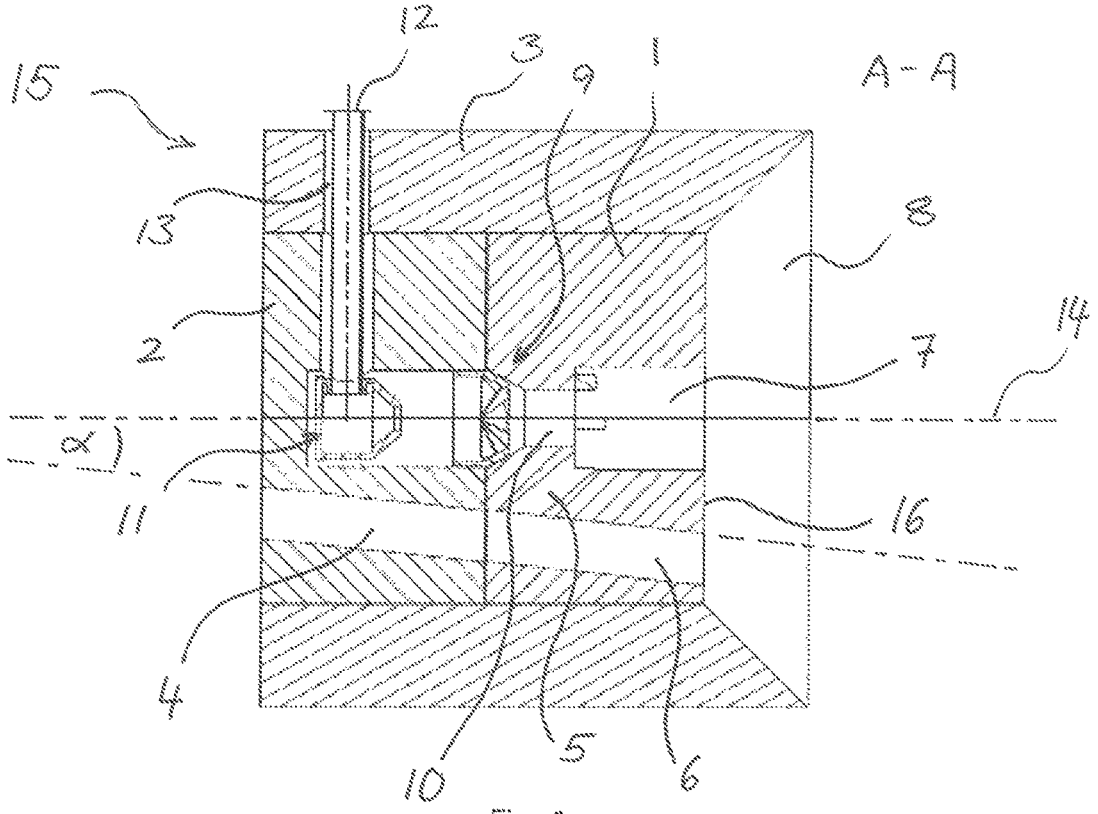

| | | | | |
|---|---|---|---|---|
| 3,418,062 | A | 12/1968 | Hovis et al. | |
| 4,969,814 | A * | 11/1990 | Ho | F23C 7/00 431/8 |
| 6,926,516 | B1 * | 8/2005 | Sudo | F23L 15/02 431/8 |
| 7,163,392 | B2 | 1/2007 | Feese et al. | |
| 7,175,423 | B1 * | 2/2007 | Pisano | F23C 6/045 431/10 |
| 2014/0329187 | A1 * | 11/2014 | Paubel | F23D 11/383 431/12 |
| 2015/0133709 | A1 * | 5/2015 | Martin | F23D 14/10 585/650 |
| 2019/0309942 | A1 * | 10/2019 | Zink | F23M 5/025 |

FOREIGN PATENT DOCUMENTS

| | | | |
|---|---|---|---|
| EP | 2653567 | B1 | 11/2015 |
| EP | 3098512 | A1 | 11/2016 |
| GB | 1187445 | | 4/1970 |
| JP | H08226618 | A | 9/1996 |

* cited by examiner

REGENERATIVE BURNER FOR STRONGLY REDUCED NOX EMISSIONS

The invention relates to a burner for burning liquid or aerosol fuels, in particular, gaseous fuels, which can be used for heating, melting and keeping warm in the case of processes with high temperature requirements, such as in melting furnaces. A corresponding method is also indicated.

Examples of gaseous fuels include natural gas (with a main component of methane), ethane, propane, butane, ethene, pentane and hydrogen.

One of the formation mechanisms of $NO_x$ (nitrogen oxide) is thermal $NO_x$. This occurs when a mixture of nitrogen and oxygen reaches very high temperatures over a period of time. Thereby, the influence of high temperatures is at a disproportionately high level. Regenerative burners of aluminium melting furnaces are very susceptible to the formation of thermal $NO_x$. The reason for this is that the temperatures in the furnace can become very high and that the air is preheated to a very high temperature even before combustion. This results in very high peak temperatures in the flame, which in turn can lead to high levels of $NO_x$ emissions.

From prior art, the following options for reducing $NO_x$ emissions are already known:

Oxygen burners reduce $NO_x$ emissions due to the lack of nitrogen. However, combustion must be controlled in a precise manner. In the event that leaks of the furnace chamber or other phenomena air come into contact with the flame, $NO_x$ emissions sharply increase.

A large distance between the air and gas nozzles promotes better internal recirculation. However, this has the disadvantage that the burner head is enlarged, thereby giving rise to a lack of space. In addition, the mixing of air and gas can be interrupted in the event of unfavourable charging in the case of a decentralized gas lance, which can result in CO (carbon monoxide) emissions.

External recirculation between air and gas is possible, however, this reduces the efficiency of the burner and is complex to carry out.

Alternatively, a stepped combustion can be conducted, but this can only reduce emissions to a certain point or degree.

DE 41 42 401 A1 describes a method for operating a furnace heating system based on one or a plurality of burners. Thereby, among other things, oxygen is used to reduce nitrogen oxide formation to burn the fuel.

The object of the present invention is to reduce the $NO_x$ emissions and simultaneously provide an efficient and cost-effective burner.

For this purpose, the invention specifies a burner according to the invention for burning liquid or aerosol fuels, in particular, gaseous fuels, particularly according to Claim 1. In particular, it has to do with a refractory burner body. The burner body comprises a gas nozzle and a plurality of air nozzles, which are at least partially formed as integral mouldings in the burner body and flow out at a front side of the burner body. Here, the air nozzles are symmetrically arranged around the gas nozzle and diverge at an angle $\alpha$ to the gas nozzle.

This has the advantage that the emission and distribution of air away from the flame results in lower $NO_x$ emissions. Thus, the gas is not completely burned immediately upon being discharged from the gas nozzle, but first distributed in the furnace. The angle can therefore eject the air at a diverging angle, prolong the flame, and increase the mixing of air and natural gas with exhaust gas, resulting in lower peak temperatures and thereby, lower $NO_x$ emissions as well.

The longer flame front, which is formed due to the symmetrical distribution of the air emitted from the air nozzles, results in a more uniform heat transfer with no temperature peaks or only low-level ones.

As a result, but also due to the stronger temperature distribution, the refractory material, in particular, that of the burner, is subjected to a lower load, thereby extending the life of the material and the device equipped with it.

The symmetrical arrangement of the air nozzles, in particular, their outlet opening(s) at the outlet or front side of the burner, means, among other things, that these are arranged concentrically around the gas nozzle and have at least one axis of symmetry. In the case of a plurality of symmetry axes, each axis of symmetry can have the same angle to the adjacent axis of symmetry. In addition, the air nozzles can assume different spacings to the gas nozzle. Preferably, the air nozzles lie on one or a plurality of concentric circles in particular around the gas nozzle and are evenly distributed on this or these, i.e. on the respective circle at the same distance to one another. In a preferred embodiment, the air nozzles are aligned on an outer circle with an angle $\beta$, and the air nozzles on the inner circle or the inner circles with an angle $\alpha$, wherein angle $\alpha$ is less than angle $\beta$; alternatively, the angle of the air nozzles of a circle becomes linearly or exponentially smaller with each circle closer to the gas nozzle.

Likewise, the symmetry axes may affect not only the arrangement of the air nozzles, but also their embodiment, in particular, their outlet opening(s). Here, their shape and/or size or outlet surface are to be understood, which are formed to be point- and/or axis-symmetric.

The use of air as a gas mixture additionally facilitates the production and use of a corresponding plant, in particular, a furnace, with one or a plurality of burners according to the invention. Here, the ambient air is sucked in and then preferably filtered (for gas and/or dust), dried, pre-cooled and/or pre-heated before it is fed into the air nozzles of the burner.

The gas nozzle is preferably supplied with gaseous fuel but can also be operated with other liquid or aerosol fuels. In the case of aerosols, i.e. solid particles or liquid particles in a gas, the particles indicated form the fuel. In addition, the burner, in particular, the gas outlet nozzle, can comprise an atomizer to distribute and mix the particles in the gas.

Furthermore, it has been shown to be favourable if the angle between the gas nozzle and one or a plurality of air nozzles, in particular, one or a plurality of main combustion air nozzles, is at a range of 1 to 45 degrees. Preferably, the angle $\alpha$ is 4 degrees. The smaller the angle $\alpha$ is, the better the air emitted can carry the gas. The larger the angle $\alpha$, the better the distribution of the air emitted in front of the burner or in the furnace becomes. The air enters the combustion chamber via the air nozzle. Since the air nozzles are simultaneously arranged diverging with each other, the air first flows away from the gas jet. Due to the increasing mixing with exhaust gas, however, the gas jet and the air jets spread in such a way that, after a certain period of time, the gas jet and the air jets meet. The angle between the two air nozzles is therefore smaller than the angle at which the rays spread from the outlet opening (also known as the beam or outlet angle). Here, the outlet angle is preferably 18° and describes the directional effect of the nozzle. The directional effect of a nozzle is to be understood, in particular, as the angle of the velocity vectors of the gas particles; the more portions of the outgoing gas having a velocity that is parallel to the axis of a nozzle there are, the smaller the angle of the emanating gas is and the more far-reaching the emanating gas is and the more impetus is generated.

In order to achieve a better air distribution with a simultaneously good directional effect of the air nozzles, the burner body can comprise two to eight, preferably four, air nozzles. In addition, the symmetrical and simultaneously directed air distribution increases with the number of air nozzles. While a small number of air nozzles allow for better mixing of air with exhaust gases, thus reducing combustion of the gas, combustion temperature and $NO_x$ emission, a larger number of air nozzles has a better symmetrical distribution characteristic. Four air nozzles form an optimal embodiment between $NO_x$ emission and the symmetrical distribution of the emitted air.

Another advantageous embodiment option lies in the size adaptation of the outlet openings of the air nozzles. Thereby, the air nozzles should comprise outlet openings with a total surface that is not more than half of a circular surface of the front side of the burner body.

Likewise, the air nozzles can comprise outlet openings, the width of which grows radially from the gas nozzle. Here, the outlet openings can form trapezoidal outlet surfaces on the front side of the burner. As a result, the amount or air volume of the air emitted increases towards the outer edge of the front side so that a mixing of the air with the gas does not take place abruptly and at a spatial point, but steadily and spatially distributed.

In a further advantageous embodiment, the gas nozzle has a pre-combustion chamber, which is formed in the burner body. In addition, each or at least one air nozzle comprises a pre-combustion air nozzle that connects the air nozzle to the pre-combustion chamber. By feeding part of the air from the air nozzle into the pre-combustion chamber, a stepped combustion by the burner is carried out, which avoids or at least reduces temperature peaks. In addition, a better ignition of the gas-air mixture in the pre-combustion chamber is possible, in particular, due to the better mixing of the fuel by a swirl nozzle and the supplied air via the pre-combustion air nozzle(s).

Furthermore, the gas nozzle preferably has a swirl nozzle for swirling the fuel, which is used in the burner body. This has the advantage of promoting a mixture of the fuel with the air in and/or after the swirl nozzle and thus, a spatially distributed combustion of the gas.

Preferably, the burner body is formed by a first quarl with the front side, a second quarl, which is arranged coaxially to the first quarl, and a third quarl, in particular, with a burner orifice, as the outer sheath of the first and second firing stone. The split burner head or body is substantiated on a manufacturing engineering level since it can be cast better in this way. The quarls are preferably cast in a separate steel casing. The division of the burner body into a first and second quarl allows for simpler insertion of the gas outlet nozzle and the swirl nozzle to take place. The burner orifice is funnel-shaped and can comprise an angle to the longitudinal or gas-flame axis at a range of 15 to 75 degrees. Furthermore, in preferred embodiments, these angles are always greater than the angle, so as not to compress and mix the combustible gas and the air immediately at the outlet from the burner. Likewise, the burner orifice can be provided by the inner geometry of the furnace instead of at the third quarl, which is why the third quarl can be dispensed with from the burner body in other embodiments.

The quarls are preferably cylindrical but can also be square or elliptical in shape. In the case of a rectangular front side, attention is furthermore paid to a symmetrical arrangement of the air nozzles around the gas nozzle, wherein the arrangement is also symmetrical to the rectangular front side of the burner, in particular, the first and third quarl.

In addition or alternatively, the air nozzles, in particular, their outlet opening(s), can comprise an orifice or frame tapering towards the outside to accelerate the air and thus improve the directional effect of the emitted air. As an addition or an alternative, the same feature with regard to the tapering can be formed in the case of the gas nozzle, in particular, its outlet opening(s). Furthermore, the said outlet openings may be shaped in such a way to eject the air and/or the gas in a certain direction and thus form the said angle.

The gas nozzle and/or the air nozzles may be partially or completely formed as a single piece in the burner body by means of mouldings and/or mechanical post-machining. In addition, components may be used in the burner body, which form the nozzles and their paths or conduits at least partially. These components can serve as a connecting piece between multi-part quarls, which influence the direction and/or velocity of the gas or air and/or seal the corresponding nozzle from external gases, as may be the case, for example, with the swirl nozzle. Preferably, pressed refractory wool or paper is used as a filling and/or sealing material in and/or around the burner, in particular between the quarls.

When using the burner, the air preferably emits at a velocity of 80 to 200 m per second. The gas preferably emits at a velocity of 30 to 100 m per second.

The present invention also indicates a method according to the invention for burning liquid or aerosol fuels, in particular, gaseous fuels with reduced $NO_x$ emissions, in particular, according to Claim 9. In this method, at least the following steps are carried out:

providing a gaseous fuel;

providing a gas mixture with oxygen and nitrogen, in particular, air, which is suitable for oxidation of the fuel;

emitting and igniting the fuel into a gas flame; and emitting the gas mixture in at least two directions, each of which diverges at a certain angle to the ejected fuel or to the gas flame.

The resulting advantages, such as lower $NO_x$ emissions, a more uniform heat transfer and a lower load on the refractory material, were explained in the case of the burner according to the invention.

Preferably, when emitting and igniting the liquid fuel or aerosol fuel, in particular, gaseous fuel, a partial volume of the gas mixture is provided to the fuel in such a way that a certain percentage of the fuel undergoes pre-combustion. This pre-combustion results in a gradual pre-combustion of the gas, a stronger temperature distribution and the elimination or at least the reduction of temperature peaks during combustion.

Furthermore, the gaseous fuel is swirled before being discharged and/or rotated. This allows for a better mixing with the gas mixture and thus a better spatially distributed combustion instead of selective combustion areas.

Favourably, the gas mixture is emitted in such a way that the at least two directions are equally spaced to each other or have the same angle around the gas flame. In other words, the exit directions on a plane perpendicular to the gas flame or its longitudinal axis form intended (intersection) points, which lie on a concentric circle around the flame and are evenly distributed on this circle.

The figures described below refer to preferred exemplary embodiments of the burner according to the invention, wherein these figures do not serve as a limitation, but essentially serve as an illustration of the invention. Elements from different figures, but with the same reference numbers are identical; therefore, the description of an element from one figure is also valid for equal or numbered elements from other figures.

Figure 2:
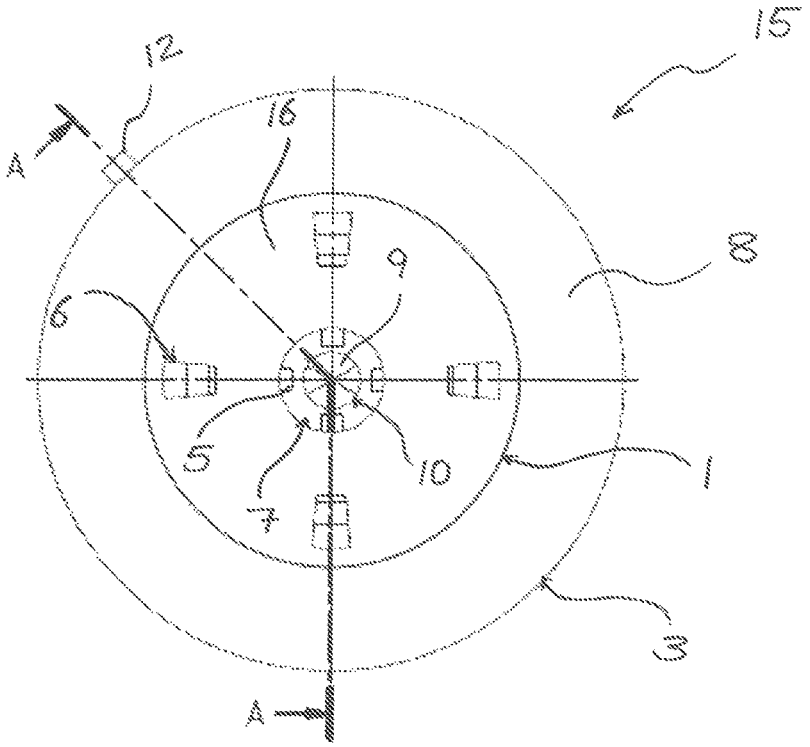

The figures show:

FIG. 1 a cross-section through a burner in accordance with a preferred exemplary embodiment; and FIG. 2 a top view of the front side of the burner in FIG. 1.

In FIG. 1, the burner 15 according to the invention is shown, which comprises a burner body, which is formed by a first quarl 1, a second quarl 2 and a third quarl 3. All three quarls 1, 2, 3 are individual parts of the burner body and abut each other. The first and second quarl 1, 2 are cylindrical and the third quarl 3 is hollow cylindrical in shape, wherein the first and second quarl 1, 2 are arranged in the third quarl 3. For this purpose, the arrangement can be precise or, if there are dimensioning inaccuracies, be implemented or provide support by means of insulating wool and/or refractory paper/wool between the quarls. For a predetermined alignment of the three quarls 1, 2, 3 to each other, these groove/spring devices can comprise rails and/or attachments or elevations and recesses, thereby making a targeted or predetermined composition of the quarls possible.

The burner 15 shown is equipped with a gas nozzle and four air nozzles. In this case, the gas nozzle preferably comprises the following components, which are arranged sequentially and coaxially or along a longitudinal axis 14 to each other: a hollow-cylindrical outlet nozzle 11 made of metal, which is supplied with gas via a feed line 12; a swirl nozzle 9 for swirling the gas, which is used in the second quarl 2; a tubular mixing path 10, through which the swirled gas is passed; a pre-combustion chamber 7, into which the mixing path 10 as well as four pre-combustion air nozzles or conduits 5 of the air nozzles flow. In this pre-combustion chamber 7, the swirled gas is mixed with the air from the pre-combustion air nozzles 5 and preferably initially ignited. The mixing path 10 and the pre-combustion chamber 7 are formed as a single piece in the first quarl 1. The swirl nozzle 9 is located at the transition from the second quarl 2 to the first quarl 1. In this case, the swirl nozzle 9 can be created in such a way that no gases from the (boundary) layer between the first and second quarl 1, 2 can enter into the gas nozzle; i.e. the outer side of the swirl nozzle 9 preferably seals the gas nozzle against unwanted gases or against gas leaks. The outlet nozzle 11 is arranged in a cavity in the second quarl 2, wherein the gas supply 12 is arranged in a cooling line 13, which feeds for cooling the feed line 12 and the outlet nozzle 11 preferably cooled air. This prevents premature ignition of the gas due to elevated temperatures, especially before the gas enters the swirl nozzle 9. In addition, the air of the cooling line 13 protects the metallic components of the burner. In other embodiments, a burner may comprise a plurality of gas-feed and cooling-air lines. Each air nozzle preferably has the following components: an air conduit 4, which is formed in the second quarl 2; a main combustion air nozzle or conduit 6, which is formed in the first quarl 1 and connected to the air conduit 4; as well as a pre-combustion air nozzle or conduit 5, which is also formed in the first quarl 1 and branches off from the main burner air nozzle 6 into the pre-combustion chamber 7. Thus, except for the outlet nozzle 11, the feed line 12 and the swirl nozzle 9 all other, in particular mentioned above components of the burner 15 in the quarls 1, 2, 3 are formed by cavities.

In FIG. 1, the angle between the longitudinal axis 14 (or also the gas nozzle) and an air nozzle is drawn, which indicates the air flow diverging to an emanating gas or a gas flame. In this case, the conduit 4 and the main combustion nozzle 6 are formed to be identical to each other and form a conduit with a constant shape, thickness and width from the back of the burner 15 to the front side 16 of the burner 15. The angle is formed, in particular, between the longitudinal axis 14 and the inner side or inner edge of the air conduit 4 or the main combustion nozzle 6. In other embodiments, the conduit 4 and the nozzle 6 may differ; in this case, other components, such as the outlet opening of the air nozzle, in particular, the main combustion air nozzle 6 at the front side, can be formed in such a way that the air is emitted at an angle of the longitudinal axis 14.

Preferably, the burner body or at least one or all of the quarls 1, 2, 3 is refractory. The first quarl 1 comprises a circular front side/surface 16 and the third quarl 3 comprises a burner orifice 8 enlarging in the shape of a funnel. In particular, these components 16, 8 as well as the pre-combustion chamber 7 are designed to be at least refractory; or alternatively formulated, components that stand up against the combustion or gas flame and/or are subjected to the heat/radiation thereof. The four main combustion air nozzles 6 and the pre-combustion chamber 7 flow out on the front side 16. Thereby, these components form openings or outlet surfaces, which are arranged symmetrically around the longitudinal axis 14.

The cross-section shown in FIG. 1 through the burner 15 according to the invention takes place at a certain angle, less than 180 degrees along the longitudinal or symmetry axis 14. Thus, both the gas supply conduit of the gas nozzle as well as the air conduit 4 is visible for the air supply of the air nozzle; ultimately, four air nozzles are formed symmetrically and would not show the cooling-air line 13 with the feed line 12 in the case of a straight cross-sectional area in contrast to the surfaces shown at an angle to one another. Air nozzle and gas nozzle or their conduits are separated from each other in the second and third quarl 2, 3.

In FIG. 2, the burner 15 in FIG. 1 is shown in a top view. In this case, in particular, the circular front side/surface 16 of the first quarl 1 and the annular burner orifice 8 of the third quarl 3 is shown. In the centre of the front side 16, through which the longitudinal axis of the burner 15 passes, the partial pocket hole of the pre-combustion chamber 7 is formed with the subsequent mixing path 10 and the swirl nozzle 9. The pre-combustion chamber 7 is a partial blind hole, since it does not completely terminate with the exception of an annular bottom. On the ground, the four openings to the pre-combustion air nozzles 5 are each arranged at a 90-degree angle towards each other around the centre point or the longitudinal axis.

The four openings of the main combustion air nozzles 6 are radially aligned from the longitudinal axis of the burner 15, in particular, cross-shaped and identical to the four pre-combustion air nozzles 5. It is noted that the area of an outlet opening of the main combustion air nozzle 6 is the same size and/or shaped as the cross-section of the main combustion air nozzle 6 within the first quarl 1. In other embodiments, the outlet openings and their connected conduits, such as the main combustion air nozzles 6, the pre-combustion air nozzle 5 and the air conduits 4, can differ in their shape and/or size. The openings shown each form a trapezoidal surface, which tapers toward the longitudinal axis or widens towards the outer circumference of the burner 15. Instead of the trapezoidal shape, other shapes of the plate are possible in other embodiments.

REFERENCE LIST

1 first quarl, front side of the burner
2 second quarl. rear side of the burner

3 third quarl, outer shell of the burner
4 air conduit
5 pre-combustion air nozzle/conduit
6 main combustion-air nozzle/conduit
7 pre-combustion chamber
8 burner orifice
9 swirl nozzle
10 mixing path
11 outlet nozzle
12 gas-nozzle feed line
13 cooling-air line
14 (symmetry) axis
15 burner
16 front side/surface of the burner, in particular, of the first quarl.

The invention claimed is:

1. A burner comprising:

a refractory burner body for burning gaseous fuel, the refractory burner body comprising a front side and a back side, the front side consisting of a gas nozzle and a plurality of air nozzles that are formed in the refractory burner body, wherein the gas nozzle comprises at least one exit orifice shaped to eject the gaseous fuel in a direction parallel to a longitudinal axis of the gas nozzle, and each of the plurality of air nozzles eject air and are arranged symmetrically around the longitudinal axis of the gas nozzle, each of the air nozzles are arranged and formed to diverge with respect to each other, and each of the air nozzles being angled with respect to the longitudinal axis of the gas nozzle such that all of the air is ejected through each of the air nozzles that are angled, and wherein each of air nozzles comprise an outlet opening having a width that grows radially from the gas nozzle, wherein the outlet opening for each of the air nozzles forms a trapezoidal outlet surface on the front side of the burner body, the trapezoidal outlet surface tapers toward the longitudinal axis of the gas nozzle and widens towards an outer circumference of the burner, wherein the gas nozzle comprises a pre-combustion chamber which is formed in the refractory burner body, and at least one of the air nozzles comprises a pre-combustion air nozzle which connects the at least one air nozzle to the pre-combustion chamber and wherein the refractory burner body is formed by a first quarl with the front side and wherein the pre-combustion chamber and the pre-combustion air nozzle are formed in the first quarl, wherein the refractory burner body is formed by a second quarl which is arranged coaxially to the first quarl, and a third quarl with a burner orifice and is designed as an outer shell of the first and second quarl and wherein the second quarl includes a plurality of air conduits and the first quarl includes the plurality of air nozzles connected to the plurality of air conduits.

2. The burner according to claim 1, wherein the gas nozzle comprises an atomizer.

3. The burner according to claim 1, wherein each the air nozzles comprises an orifice or frame tapering towards an outer surface of the burner orifice.

4. The burner according to claim 1, wherein the pre-combustion air nozzle is radially aligned with the at least one of the air nozzles.

5. The burner according to claim 1, further comprising a tubular mixing path through which the gaseous fuel is swirled and passed prior to combustion.

6. The burner according to claim 5, wherein the tubular mixing path is formed in the first quarl.

7. The burner according to claim 1, wherein each of the air nozzles is angled at an angle a between 1 and 45 degrees relative to the longitudinal axis of the gas nozzle.

8. The burner according to claim 1, wherein the plurality of air nozzles comprises two to eight air nozzles.

9. The burner according to claim 1, wherein all outlet openings for the air nozzles have a total area that is not more than half of a circular surface of the front side of the refractory burner body.

10. The burner according to claim 8, wherein the plurality of air nozzles comprises four air nozzles.

11. The burner according to claim 1, wherein each of the air nozzles extend fully through the refractory burner body.

12. The burner according to claim 7, wherein the angle $\alpha$ is 4 degrees relative to the longitudinal axis of the gas nozzle.

* * * * *